US011318756B2

(12) United States Patent
Brett

(10) Patent No.: US 11,318,756 B2
(45) Date of Patent: May 3, 2022

(54) POSITIONING SYSTEM FOR OBJECT PROCESSING

(71) Applicant: Kenton Brett, Indianapolis, IN (US)

(72) Inventor: Kenton Brett, Indianapolis, IN (US)

(73) Assignee: Kenton Brett, Indianapolis, IN (US)

( * ) Notice: Subject to any disclaimer, the term of this patent is extended or adjusted under 35 U.S.C. 154(b) by 0 days.

(21) Appl. No.: 17/030,305

(22) Filed: Sep. 23, 2020

(65) Prior Publication Data

US 2021/0086528 A1 Mar. 25, 2021

Related U.S. Application Data

(60) Provisional application No. 62/925,348, filed on Oct. 24, 2019, provisional application No. 62/903,992, filed on Sep. 23, 2019.

(51) Int. Cl.
*B41J 3/407* (2006.01)
*B41M 5/00* (2006.01)

(52) U.S. Cl.
CPC ..... *B41J 3/40731* (2020.08); *B41J 3/40733* (2020.08); *B41M 5/0088* (2013.01)

(58) Field of Classification Search
CPC . B41J 3/40731; B41J 3/40733; B41M 5/0088
See application file for complete search history.

(56) References Cited

U.S. PATENT DOCUMENTS 5,207,153 A 5/1993 Thomason
5,954,244 A 9/1999 Nichol et al.
6,923,115 B1 8/2005 Litscher et al.
9,827,784 B1 11/2017 Buchar et al.
9,925,726 B1 * 3/2018 Bradway ..... B41J 3/4073
10,104,873 B2 10/2018 Elferink
10,654,261 B2 5/2020 Brett
(Continued)

FOREIGN PATENT DOCUMENTS

EP 2851199 A1 3/2015
WO 2007085825 A1 8/2007

OTHER PUBLICATIONS

Direct Color Systems, "Custom Bottle Printing is Easier Than Ever", http://www.directcolorsystems.com/custom-bottle-printing-is-easier-than-ever/, Sep. 18, 2015 (2 pages).
(Continued)

*Primary Examiner* — Scott A Richmond
(74) *Attorney, Agent, or Firm* — Maginot, Moore & Beck, LLP

(57) ABSTRACT

A method of printing on a plurality objects comprises arranging a first plurality of objects on a board having a flat upper surface, the first plurality of objects arranged on the board in a first configuration, and adhering a plurality of rail members to the flat upper surface of the board, the plurality of rail members arranged around a perimeter of each of the first plurality of objects to define borders for each of the first plurality of objects in the first configuration. The method further comprises positioning the board on a printer, printing on the first plurality of objects with the printer, and removing each of the first plurality of objects from the board. The method further comprises subsequently printing a second plurality of objects on the board.

20 Claims, 14 Drawing Sheets

(56) References Cited

U.S. PATENT DOCUMENTS

| | | | | |
|---|---|---|---|---|
| 2005/0104241 | A1 | 5/2005 | Kritchman et al. | |
| 2009/0256897 | A1* | 10/2009 | Polk | B41F 17/00 347/104 |
| 2010/0186610 | A1 | 7/2010 | Polk | |
| 2011/0036252 | A1 | 2/2011 | Middo | |
| 2014/0299009 | A1 | 10/2014 | Miller et al. | |
| 2014/0310891 | A1 | 10/2014 | Miller et al. | |
| 2016/0221328 | A1 | 8/2016 | Till | |
| 2017/0073163 | A1* | 3/2017 | Brett | B41F 17/30 |
| 2017/0320316 | A1 | 11/2017 | Nakamura | |

OTHER PUBLICATIONS

IDS Digital, "High Speed 360° Digital Printing", Revolution 360° Digital Printer, http://www.ids-digital.com/revolution-360-printer/, last accessed on Aug. 29, 2016 (3 pages).

Leek, Bill, "Printing in the Round: UV Cured Cylindrical Printing Offers New Opportunities", https://a-e-mag.com/features/printing-round-uv-cured-cylindrical-printing-offers-new-opportunities, Jul. 1, 2015 (4 pages).

Inkcups Now, "Inkjet Printing on Bottles", Cylinder Printer XR, http://www.inkcups.com/equipment/industrical-uv-inkjet-pringers-cylinder-printer/Default.aspx, last accessed on Aug. 29, 2016 (2 pages).

Mimaki USA, "Kebab option: 360-degree direct printing on cylindrical products", http://www.mimakiusa.com/products/uv/ujf-3042hg-ujf-6042-kebeb-option/, last accessed on Aug. 29, 2016 (3 pages).

Partial Supplemental European Search Report for related application EP 16845256.3, dated Feb. 28, 2019.

International Search Report and Written Opinion, dated Dec. 26, 2016, issued in corresponding application No. PCT/US2016/051258.

* cited by examiner

POSITIONING SYSTEM FOR OBJECT PROCESSING

CROSS-REFERENCE TO RELATED APPLICATIONS

This application claims priority to U.S. Provisional Patent Application No. 62/903,992, filed Sep. 23, 2019, and U.S. Provisional Patent Application No. 62/925,348 filed Oct. 24, 2019, the entire contents of which are incorporated by reference herein.

FIELD

The present disclosure relates to the field of object processing, including printing and other processes.

BACKGROUND

In art, sport, home, industry and other fields, there are many processes that are applied to differently shaped objects, including round or cylindrical objects, or objects that are approximately round or cylindrical, such as octagonal or oval. When processing these objects, a fixture is needed to hold the objects in place for processing. Sometimes the process is to be applied to two or more sides of the objects, requiring them to be turned before processing them again.

Examples of processes that may be applied to objects include treatment of objects with light, chemicals or radiation, painting, washing, inspection, printing, etching, photography, and any of various additional processes. As a specific example, modern printers, such as UV ink jet printers are often used to print on curved surfaces, such as ink pens printed with a company logo along the sides. Many small batch jobs are done by placing the objects in custom fixtures, which are designed and built for each type of object or product. These fixtures are static and have profiles cut into the fixture for nesting the objects in the fixture. Objects are placed in the profiles and retained securely in place during processing. Thereafter, the fixtures may be re-used for similar jobs that process similar objects. Many of these jobs are done on small UV ink jet printers, with high gantries that allow appropriately sized objects to fit under the gantry. Such printers are often excellent for printing on round or cylindrical objects.

Custom fixtures are not always ideal, as significant time and expense is required to create the fixtures. At the same time, non-custom fixtures are not ideal, because they do not provide the desired profiles to properly retain objects during processing. Also, when the objects are rounded or cylindrical in shape, appropriate rotation of the objects for processing at various locations can be challenging. Loading and unloading of these objects can also be challenging In view of the foregoing, it would be desirable to provide a custom fixture system that may be quickly and easily assembled at a relatively low cost. It would also be advantageous to provide a method and system that is useful in assisting with processing of objects that need to be turned during processing, such as rounded or cylindrical objects. Furthermore, it would be advantageous to provide a method and system for quickly and easily loading and unloading such objects from the processing station.

SUMMARY

In at least one embodiment a method of printing on a plurality objects is disclosed. The method comprises arranging a first plurality of objects on a board having a flat upper surface, the first plurality of objects arranged on the board in a first configuration, and adhering a plurality of rail members to the flat upper surface of the board, the plurality of rail members arranged around a perimeter of each of the first plurality of objects to define borders for each of the first plurality of objects in the first configuration. The method further comprises positioning the board on a printer, printing on the first plurality of objects with the printer, and removing each of the first plurality of objects from the board. Thereafter, the method comprises arranging a second plurality of objects on the board, each of the second plurality of objects arranged within the borders defined by the rail members such that the second plurality of objects are also arranged on the board in the first configuration, repositioning the board on the printer, and printing on the second plurality of objects with the printer.

In another embodiment, a method for processing a plurality objects at a processing station is disclosed. The method comprises arranging a first plurality of objects on a board, the first plurality of objects arranged on the board in a first configuration, marking border positions on the board for each of the first plurality of objects, positioning the board on the processing station, and processing the first plurality of objects at the processing station. Thereafter, the method comprises, removing each of the first plurality of objects from the board, arranging a second plurality of objects on the board, each of the second plurality of objects arranged within the border positions marked on the board such that the second plurality of objects are also arranged on the board in the first configuration. The method further comprises repositioning the board at the processing station, and processing the second plurality of objects at the processing station.

In yet another embodiment, an object processing kit is disclosed. The object processing kit comprises a printer, a board, and a plurality of rail members. The board includes a flat upper surface and at least one registration member, the at least one registration member configured to engage at least one complementary registration member on the printer. The plurality of rail members each include a peel-and-stick flat bottom surface configured for engagement with the flat upper surface of said board.

The above described features and advantages, as well as others, will become more readily apparent to those of ordinary skill in the art by reference to the following detailed description and accompanying drawings. While it would be desirable to provide a processing positioning system and method for processing objects that provides one or more of these or other advantageous features as may be apparent to those reviewing this disclosure, the teachings disclosed herein extend to those embodiments which fall within the scope of the appended claims, regardless of whether they include or accomplish one or more of the advantages or features mentioned herein.

DESCRIPTION

Rotisserie Positioning System with Pre-Loader and Scoop

Figure 1A:
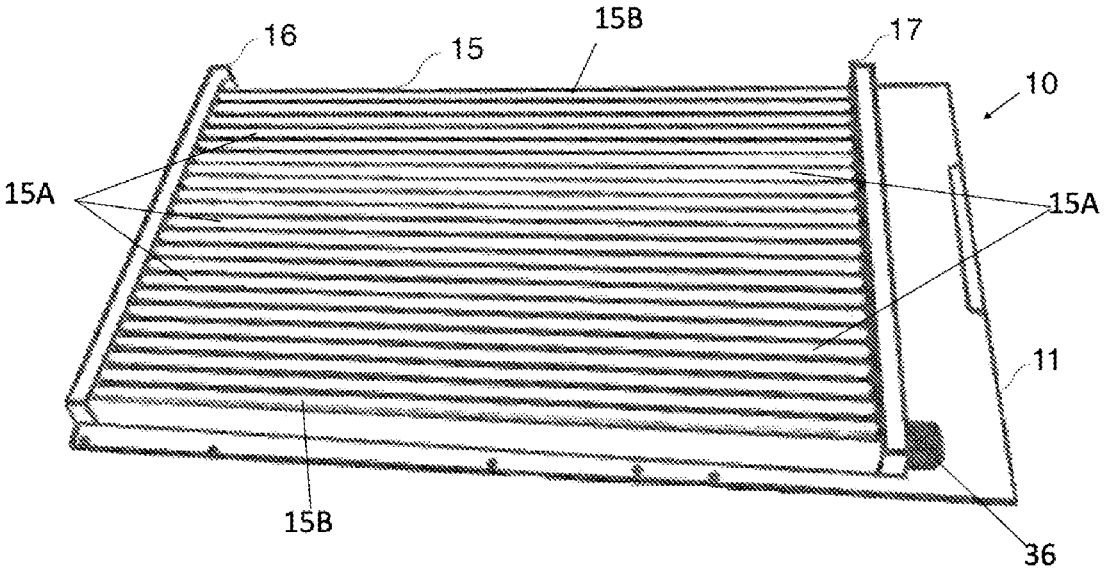
FIG. 1A shows a top perspective front view of a support mechanism including a plurality of cylindrical members for supporting a plurality of rotatable objects during processing.

FIG. 1A depicts a positioning system 10 configured to retain a plurality of rotatable objects during processing, such as during printing or other object processing. The positioning system 10 (which may also be referred to herein as a "rotisserie" or "support mechanism") generally includes a base plate 11, a plurality of elongated cylindrical members 15 extending between a first block 16 and a second block 17, and a knob 36. The cylindrical members 15 (which may also be referred to herein as "cylinders" or "rollers") are supported at their respective ends by the first block 16 and the second block 17, and are each rotatable relative to the first block 16 and the second block 17. Rotation of the knob 36 results in rotation of the plurality of cylindrical members 15 in unison. When rotatable objects are properly arranged on the cylindrical members 15, the rotatable objects also rotate in unison with the cylindrical members 15. The term "rotatable objects" is used herein to refer to any object with at least one substantially continuous circumferential surface that enables the object to be rotated with the positioning system about a rotation axis of the object without substantially changing the position of the rotation axis during rotation. Such "rotatable objects" encompass spherical or round objects, cylindrical objects, or objects with portions that are spherical, round, or cylindrical.

The positioning system 10 of FIG. 1A is generally configured similar to the one shown and disclosed in U.S. Pat. No. 10,654,261, issued May 19, 2020, the entire contents of which are incorporated herein by reference. However, in the positioning system 10 of FIG. 1A, the cylindrical members include two different types of cylindrical members, 15A and 15B. The first type of cylindrical members 15A include a high-friction outer surface (and may be referred to herein as "high-friction cylinders"). The second type of cylindrical members 15B include a low-friction outer surface (and may be referred to herein as "low-friction cylinders"). Both types of cylindrical members 15A and 15B are made of a strong, stiff, yet lightweight material, such as 16 gauge 6061 aluminum tube.

The first type of cylindrical members 15A each include an outer surface that offers a high coefficient of friction (e.g., as measured by an anti-slip coefficient or other measurement standards that measure gripping qualities for a surface). Accordingly, objects that come into contact with the outer surface of the high-friction cylinders 15A do not easily slide or slip along the outer surface. In at least one embodiment, the high-friction cylinders 15A are coated with a tackifying material, such as rubber, silicone, or the polyvinyl chloride (PVC) ink commonly known as plastisol.

In the embodiment disclosed in FIG. 1A, most of the cylinders included on the rotisserie 10 are high-friction cylinder members 15A. In at least one embodiment, all of the interior cylindrical members on the rotisserie are high-friction cylinder members 15A (i.e., all cylindrical members other than the two outer cylindrical members). Stated differently, all cylindrical members that have two neighbors are high-friction cylinder members 15A. Because objects for processing are arranged on the rotisserie in contact with two cylindrical members 15 (i.e., each of the processing objects is centered between two cylindrical members), all processing objects will come into contact with at least one high-friction cylinder 15A. Because the high-friction cylinders 15A provide an anti-slip outer surface that tends to grip objects positioned thereon, rotation of the high-friction cylinders 15A results in precise rotation of the engaged processing objects, thus allowing the operator to more easily control rotation of objects for processing resting on the rotisserie 10.

The second type of cylindrical members 15B each include an outer surface that offers a low coefficient of friction (e.g., as measured by an anti-slip coefficient or other measurement standard for the surface). Accordingly, objects that come into contact with the outer surface of the low-friction cylinders 15B tend to more easily slide or slip along the outer surface. The outer surfaces of the low-friction cylinders 15B are not coated with the same material as the high-friction cylinders 15A. Instead, the outer surfaces of the low-friction cylinders 15B may be coated with a low-friction material, or may simply be provided the same material used to form the cylinder itself (e.g., a metal such as anodized aluminum or steel). For example, in at least one embodiment, the low-friction cylinders 15B are coated with a low-friction material, such as DuPont™ Delrin® acetal, which is a low-friction high-wear resistance material offering high strength and stiffness. As another example, in at least one embodiment, the low-friction cylinders 15B may be polished or otherwise processed to make the surface of these cylinders smoother and more slippery. In most embodiments, the final diameter of the low-friction cylinders 15B is the same as the final diameter of the high-friction cylinders 15A. In at least some embodiments wherein the low-friction cylinders 15B are not coated, the diameter across the metal that forms the low-friction cylinders 15B is slightly larger than the diameter across the metal that forms the high-friction cylinders 15A in order to make the final diameter of the non-coated low-friction cylinders 15B the same as the final diameter of the coated high-friction cylinders 15A.

Figure 1B:
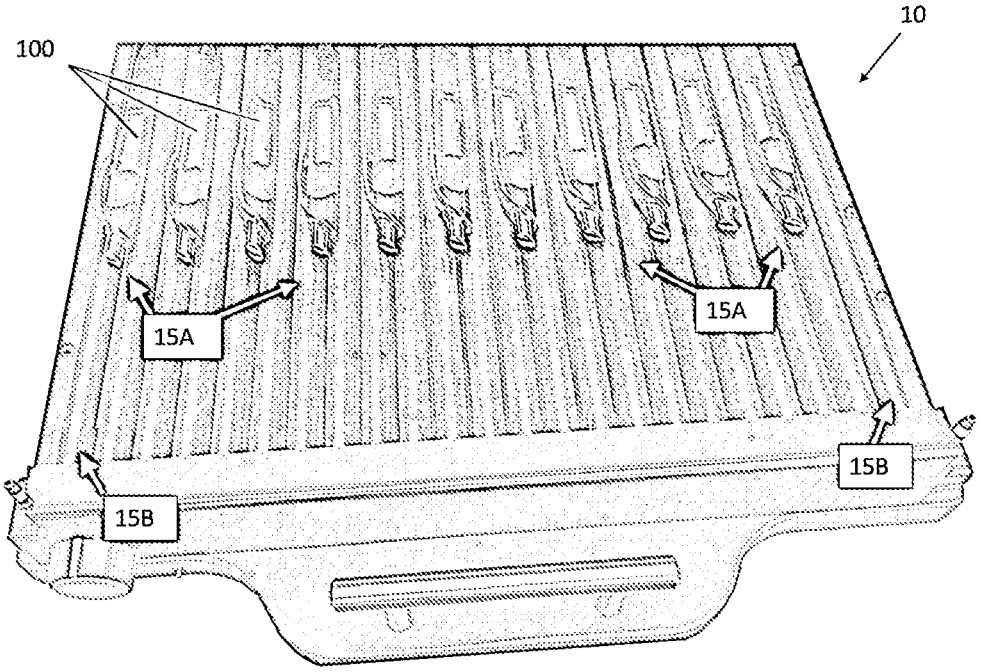
FIG. 1B shows a top perspective side view of the support mechanism of FIG. 1A with a plurality of processing objects positioned thereon.

FIG. 1B shows a side view of a rotisserie 10 with processing objects 100 in the form of ink pens resting on the cylinders 15. Each processing object rests between two cylinders and engages at least one high-friction cylinder 15A. Accordingly, when the cylinders 15 are rotated, at least one high-friction cylinder 15A is in contact with each processing object 100, and the at least one high-friction cylinder 15B effectively imparts rotation to the associated object.

In the embodiment of FIGS. 1A and 1B, only the two outer cylinders of the rotisserie 10 are low-friction cylinder members 15B. Stated differently, the cylindrical members that have only one neighbor are low-friction cylinder members 15B. As explained in further detail below, the low-friction cylinders 15B facilitate the use of accessory components, including a pre-loader 50 (see FIGS. 2A-3B) and a scoop (see FIGS. 4A-4B) to assist with loading processing objects onto the rotisserie 10, and unloading processing objects from the rotisserie. While the embodiment of FIG. 1A shows only the two outer cylinder members as low-friction cylinder members 15B, in at least some embodiments, one or more additional low-friction cylinder members 15B are also arranged on the rotisserie 10 as interior cylindrical members.

Figure 2A:
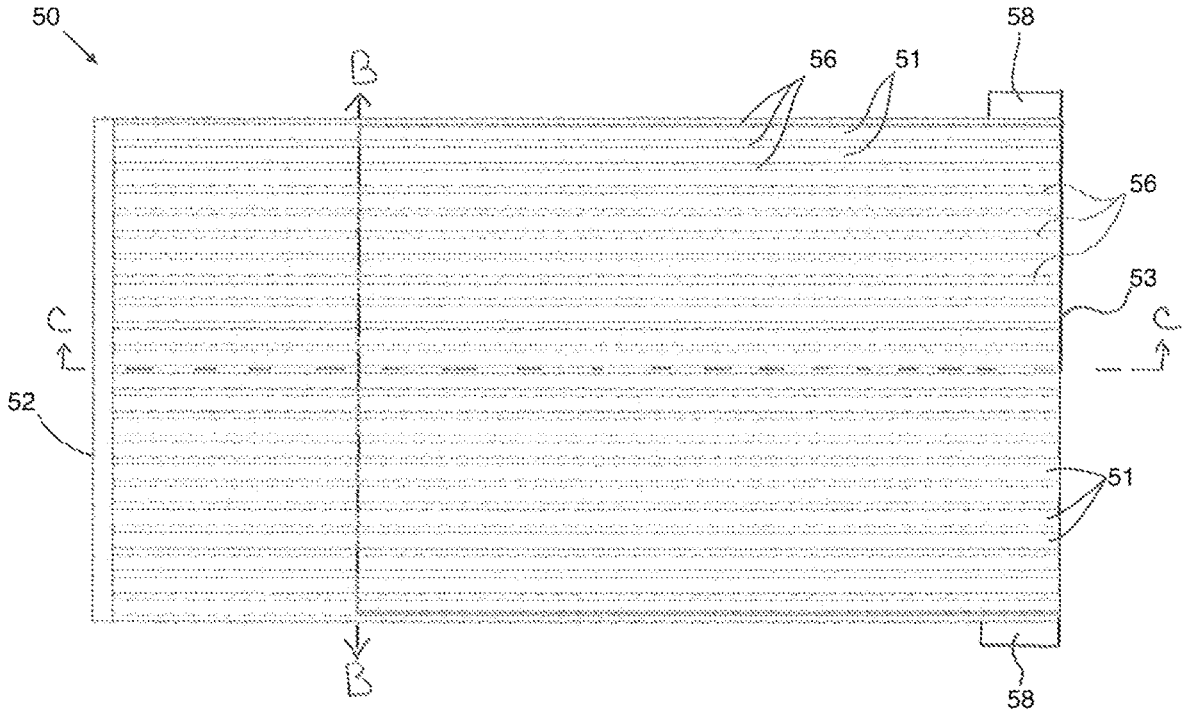
FIG. 2A shows a top perspective view of a pre-loader for use in loading processing objects onto the support mechanism of FIG. 1.
Figure 2B:
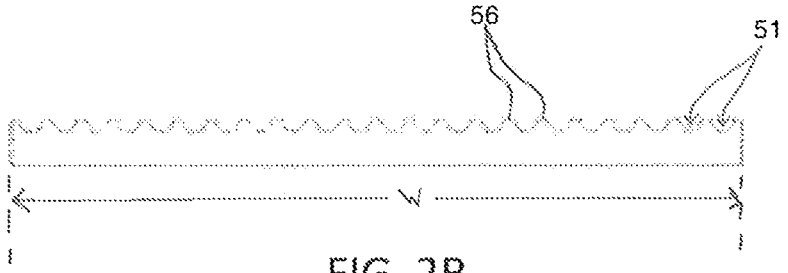
FIG. 2B shows a cross-sectional side view of the pre-loader along line B-B of FIG. 2A.
Figure 2C:
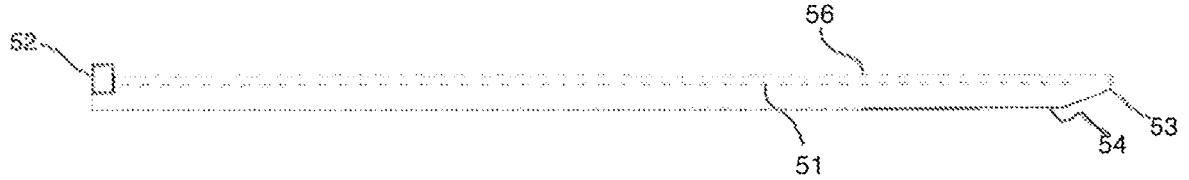
FIG. 2C shows a lengthwise cross-sectional view of the pre-loader along line C-C of FIG. 2A.
Figure 2D:
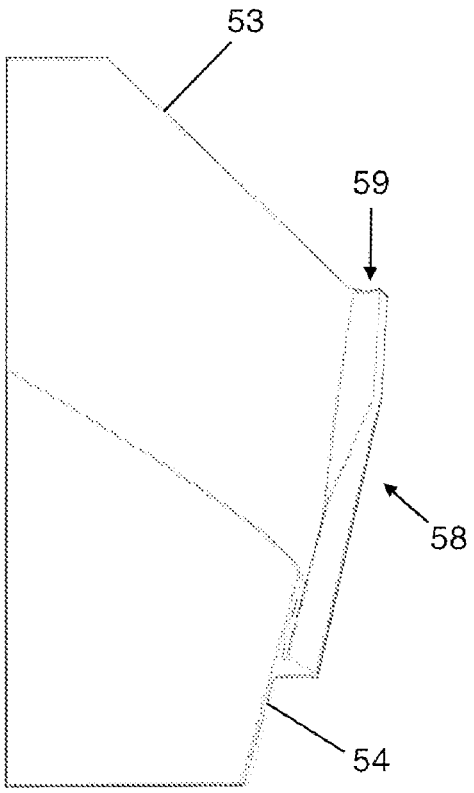
FIG. 2D shows a bottom perspective view of the front edge of the pre-loader of FIG. 2A.

With reference now to FIGS. 2A-2D, the pre-loader 50 (which may also be referred to herein as a "loading device") is similarly configured to the loading device of U.S. Pat. No. 10,654,261. The pre-loader 50 includes an upper surface that defines a plurality of parallel troughs or grooves 51, a rear bumper 52, and a tapered front end 53, and additionally includes two guide wings 58. As best shown in FIG. 2B, the parallel grooves 51 are separated by parallel peaks 56 that extend lengthwise across the pre-loader 50. The width, w, of the pre-loader is similar to the width of the rotisserie 10 such that the pre-loader can be placed over the rotisserie 10 and extend across all of the cylindrical members 15. As shown in FIG. 2C, the tapered front end 53 at the bottom of the pre-loader 50 angles downward to a flat underside 54. As shown in FIG. 2D, the guide wings 58 are positioned on opposed sides of the leading edge 53 and extend below the front surface of the leading edge.

Each guide wing 58 includes a concave interior wall 59 defined by a similar radius to that of the low-friction cylindrical members. The distance between the two guide wings 58 is such that each guide wing 58 may be closely positioned to the exterior of the outer cylindrical members 15B of the rotisserie 10 when the pre-loader 50 is positioned over the rotisserie 10. At the same time, the curved interior walls 59 are configured to engage the outer cylindrical members 15B and hold the tapered front end above the interior cylindrical members 15A when the pre-loader 50 is positioned over the rotisserie 10. This allows the pre-loader 50 to be conveniently positioned upon the rotisserie 10 and easily slid across the outer low-friction cylinders 15B without engaging the inner high-friction cylinders 15A. Advantageously, the pre-loader 50 is comprised of a low-friction material that, in association with the low-friction cylinders 15B, allows the pre-loader 50 to easily slide relative to the low-friction cylinders 15B. In at least one embodiment, the pre-loader 50 is comprised of a low-friction material such as DuPont™ Delrin® acetal. This allows processing objects positioned on the pre-loader 50 to be easily slid off of the pre-loader and on to the rotisserie, as described below.

Figure 3A:
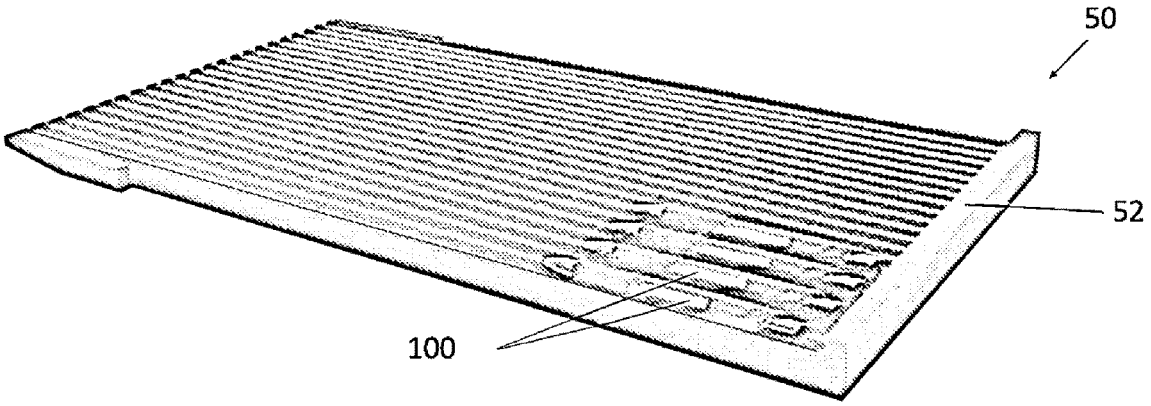
FIG. 3A shows a perspective view of the pre-loader of FIG. 2A with a plurality of processing objects positioned thereon.
Figure 3B:
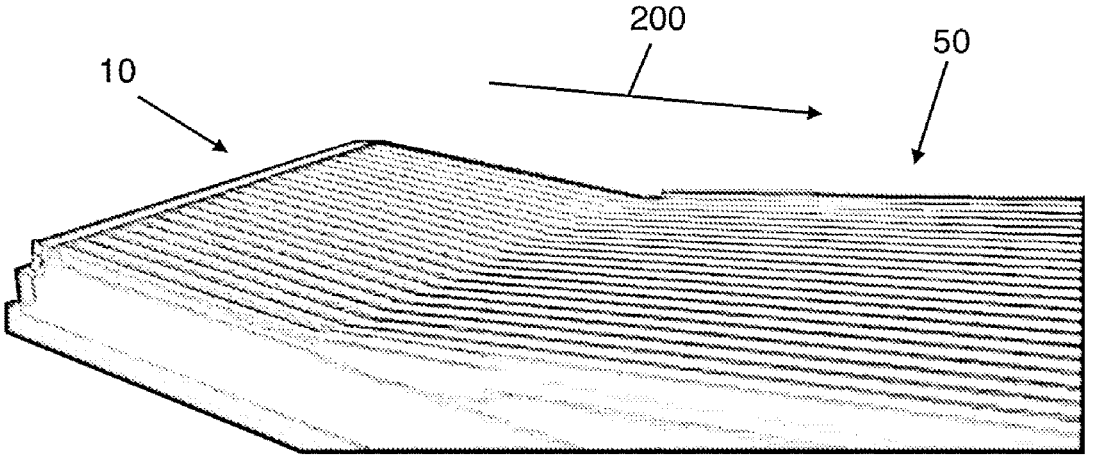
FIG. 3B shows a perspective view of the pre-loader in a loading position wherein the bottom surface of the pre-loader is in engagement with the cylindrical members of the support mechanism of FIG. 1.

As illustrated in FIG. 3A, the pre-loader 50 is configured to retain pre-loaded processing objects 100 in preparation for transfer to the positioning system 10. The processing objects 100 are aligned in parallel rows, resting in the grooves 51 of the pre-loader 50. While the positioning system is used in processing one batch of objects, the next batch of objects is loaded onto the pre-loader 50 in preparation for quick transfer to the rotisserie 10, to minimize batch turn time. As shown in FIG. 3B, this transfer is accomplished by placing the front end 53 of the pre-loader 50 against the back end of the rotisserie 10, tipping the rear end of the pre-loader 50 up for gravity assist, moving the pre-loader across the rotisserie 10 (as indicated by arrow 200 in FIG. 3B), and then sweeping the processing objects off of the pre-loader 50 in unison and in formation, and onto the rotisserie 10. Advantageously, because of the engagement of the pre-loader guide wings 58 with the low-friction cylinders 15B of the rotisserie 10, the pre-loader 50 may be smoothly and easily pulled across the rotisserie 10. Once on the processing objects are positioned on the rotisserie 10, the processing objects may be pushed or otherwise moved manually along the rollers and into the desired position for subsequent printing or other processing. With most types of objects, this can be done with a moment of slight pressure with a ruler along the last row of processing objects, pushing all objects into place simultaneously. Alternatively, one row may be adjusted at a time. Alternatively a spacing bridge may be used, as described in further detail below.

During unloading, the pre-loader 50 should be steadily guided along the rotisserie in proper alignment, thus allowing the objects to slide off into the desired positions on the rollers. As described above, low friction guide wings 58 facilitate this movement. The guide wings 58 are attached to each side of the front of the pre-loader 58, and protrude slightly down to engage the outside rollers on each side of the rotisserie. The protruding low friction guide wings 58 each have a concave circular groove/interior wall 59 with the same radius as the outer rollers, which provides broad, smooth contact with the roller for optimal operation as it slides along the roller. The guide wings 58 protrude downward at an optimal distance which functions to separate the pre-loader front lip from the rotisserie 10 rollers at a safe distance to avoid accidental friction or scraping of the bottom of the pre-loader on the rollers, while also minimizing the dropping distance of the objects onto the rotisserie. In at least one embodiment, the body of the pre-loader 50 may be widened to allow the guide wings 58 to be molded into the body of the pre-loader. The grooves in the guide wings 58 are angled to aid in maximizing contact with the two outside cylinders of the rotisserie 10 when the pre-loader 50 is tipped for gravity assist in transferring objects to the rotisserie. However, this operation may be impeded if the outer rollers have high-friction coatings. Therefore, the two outside rollers 15B in the rotisserie 10 do not to have high-friction coating or finish. Rather they are to have a low-friction coating or finish, for the guide wings 58 of the pre-loader 50 to slide upon. Because no two adjacent rollers are low-friction rollers, processing objects sitting on the roller will be in contact with at least one of the inner high-friction rollers, and thus rotate properly. For example, in the outside pen 100 shown on the leftmost side of the rotisserie 100 in FIG. 1B is resting on one low-friction roller 15B and one high-friction roller 15A, and this outer pens turn properly (note that the pen on the rightmost side in FIG. 1B is resting on two high-friction rollers 15A, and no pen engages the low-friction roller 15B on the rightmost side of the rotisserie 10).

As described above, it will be recognized that the pre-loader 50 includes the following functionality: the ability to slide easily along the rotisserie while transferring objects directly to their desired positions on the rotisserie, to guide the pre-loader along the rotisserie in correct alignment with the rotisserie, to assist the sliding transfer of objects from the pre-loader to the rotisserie with low friction, and to optimize and hold constant the distance between the pre-loader and the rotisserie during transfer. The system described herein thus provides a method for transferring objects from a pre-loader to a rotisserie. In at least some embodiments, the processing objects may be balls or other easily displaced objects and a spacing bridge (as described below) or ruler may be utilized in front of the balls to control the speed of rolling onto the rotisserie.

Figure 4A:
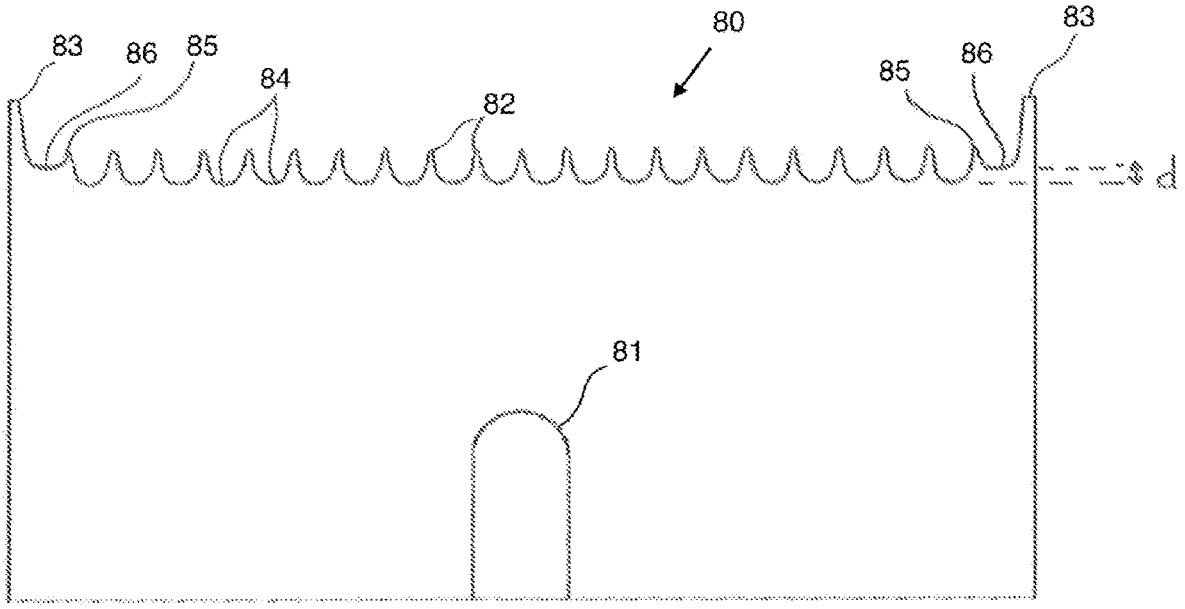
FIG. 4A shows at top view of a scoop for use in unloading processing objects from the support mechanism of FIG. 1.
Figure 4B:
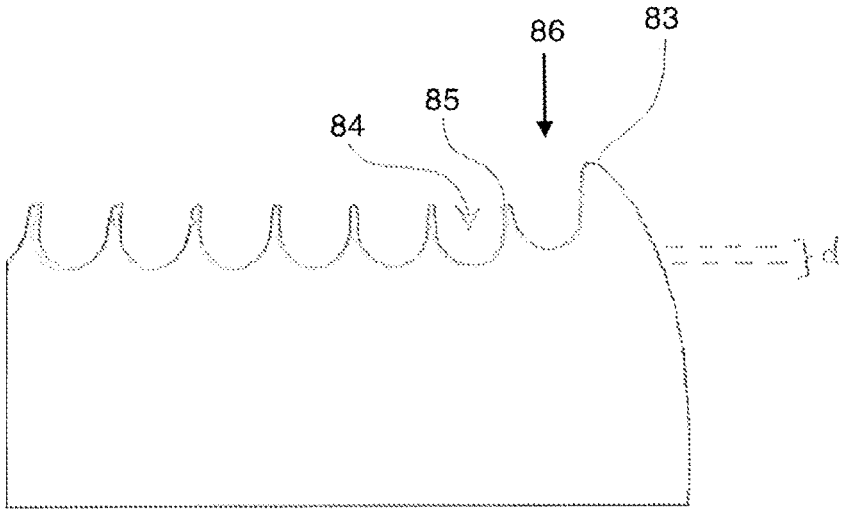
FIG. 4B shows an enlarged view of a forward edge of the scoop of FIG. 4A.

In addition to use with a loading device 50, the positioning system 10 is also configured for use with an unloading device 80. An exemplary unloading device 80 is shown in FIGS. 4A-4B. The unloading device 80, which may also be referred to herein as a "scoop" or "unloader," is similarly configured to the unloading device of U.S. Pat. No. 10,654,261, and includes a rear handle 81, front teeth 82, and side guides 83. Inner grooves 84 are defined along the front edge of the unloading device 80 between each of the front teeth 82. Additionally, in the embodiment of FIGS. 4A and 4B, outermost grooves 86 are also defined between the outermost teeth 85 and the side guides 83.

The unloader 80 is sufficiently wide such that the side guides 83 may be positioned to the outside of the outer cylindrical members 15B of the rotisserie 10. The teeth 82 are sufficiently thin to fit between the cylindrical members 15. Accordingly, the inner grooves 84 are designed and dimensioned to receive the inner cylindrical members 15A of the rotisserie 10, and the outermost grooves 86 are designed and dimensioned to receive the outer cylindrical members 15B of the rotisserie. However, the outermost grooves 86 are not as deep as the inner grooves 84. In particular, as shown in FIGS. 4A and 4B, the inner grooves 84 extend a distance, d, past the outermost grooves 86. As a result, when the unloader 80 is positioned on the rotisserie, the outermost grooves 86 engage the outer cylindrical members 15B and hold the front edge of the unloader, including the inner grooves 84 and teeth 82 slightly away from the inner cylinders 15B.

In addition to the above, the unloader 80 also has a ledge 88 crossing the scoop horizontally near the teeth, for example at a distance approximately one inch from the teeth, with the ledge serving to hinder the escape of parts that have been scooped. In the preferred embodiment, the ledge is molded into the scoop, which is made of molded plastic. In at least one embodiment, the unloader 80 is comprised of a low-friction material such as DuPont™ Delrin® acetal. Because the unloader 80 is comprised of a low-friction material, and because the outer cylindrical members 15B are also comprised of a low-friction material, this allows the unloader 80 to easily slide along the rotisserie 10.

The unloading device 80 is particularly configured for removing objects from the rotisserie 10 after printing or other processing. In operation, the teeth 82 of the scoop 80 are positioned between the rollers of the rotisserie 10, and held at such an angle as to wedge the objects into the scoop as the scoop is moved along the rotisserie. However, this operation may be impeded if the rollers have high-friction coatings causing friction with the scoop. Accordingly, the arrangement disclosed herein provides a method of scooping and a scoop with the webbing between the outer two teeth that extends past than the webbing between the other teeth, as shown in FIGS. 4A and 4B. This allows the webbing between the side guides (which may also be considered outermost teeth) to slide along the outer two rollers of the rotisserie, which are the only two rollers having low friction surfaces.

In view of the foregoing, it will be recognized that the rotisserie 10 and unloader 80 provide for a method of removing processed objects from the rotisserie 10. The method includes first placing the scoop outer webbings onto the outer low friction rollers of the rotisserie. Next, the method includes tipping the scoop up to a position such that its front edge and teeth significantly clear all the other rollers, but low enough to retain the captured objects. Thereafter, the method includes placing a thin stiff length of material, such as a ruler in front of some of the objects to brace them from sliding as they are scooped. In at least one embodiment the thin stiff length of material is the spacing bridge described in further detail below, and braces in front of an amount of objects that will easily fit in the cavity of the scoop. Next, the scoop 80 is slid along the outer rollers of the rotisserie, under the objects until the scoop meets the ruler or spacing bridge. Thereafter, the scoop is dumped to unload the processed objects. The spacing bridge is then moved to brace a new set of objects. These steps are then repeated until all objects are scooped.

Thus, the arrangement described herein includes the following functions. First, the scoop 80 slides easily along the rotisserie while transferring objects from the rotisserie to the scoop. Also, the outer grooves 86 and side guides 83 guide the scoop along the rotisserie 10 in correct alignment by using the outer two rollers as guide rails. Also, the scoop 80 includes features that act to place the front edge of the scoop 80 in a preferred position relative to the rollers 15, and hold constant the distance between the scoop and the rotisserie during transfer. Furthermore, the scoop 80 aids in retaining the scooped objects by means of a ledge spanning horizontally near the teeth.

In at least one alternative embodiment, the rotisserie includes one or more interior low-friction rollers in addition to or in lieu of the outer cylindrical members 15B. The interior low-friction rollers are identical to the outer cylindrical members 15B, but are not the outermost rollers and thus the interior low-friction rollers each have two adjacent rollers. In at least one application, these interior low-friction rollers are advantageous for use with larger rotisseries where the scoop does not span the entire rotisserie. A very wide scoop would be unwieldy for an operator to use. So if a very wide rotisserie is used to fully utilize one of the larger UV printers, the interior low-friction rollers allow for a scoop to remove parts from a portion of the wide rotisserie without damaging the rubber coated inner-rollers. As an example, if a scoop spans twenty-two rollers for one rotisserie, but there are forty rollers on another rotisserie, then the twenty-second roller from the left may be a non-rubberized, low-friction roller, as is the 22nd roller from the right. This allows the "normal-sized" scoop to be used for the left part and the right part of the rotisserie. In other applications, the interior low-friction rollers may be used in lieu of the outer cylindrical members 15B and still provide similar advantages. For example, in at least one embodiment, the second roller from the left and the second roller from the right are both low-friction rollers, and the outermost rollers are high-friction rollers. In such an embodiment, the scoop is configured with offset grooves that engage the low-friction rollers and allow the scoop to easily slide along the low-friction rollers without engaging the high-friction rollers.

Interchangeable Knob Templates

Figure 5A:
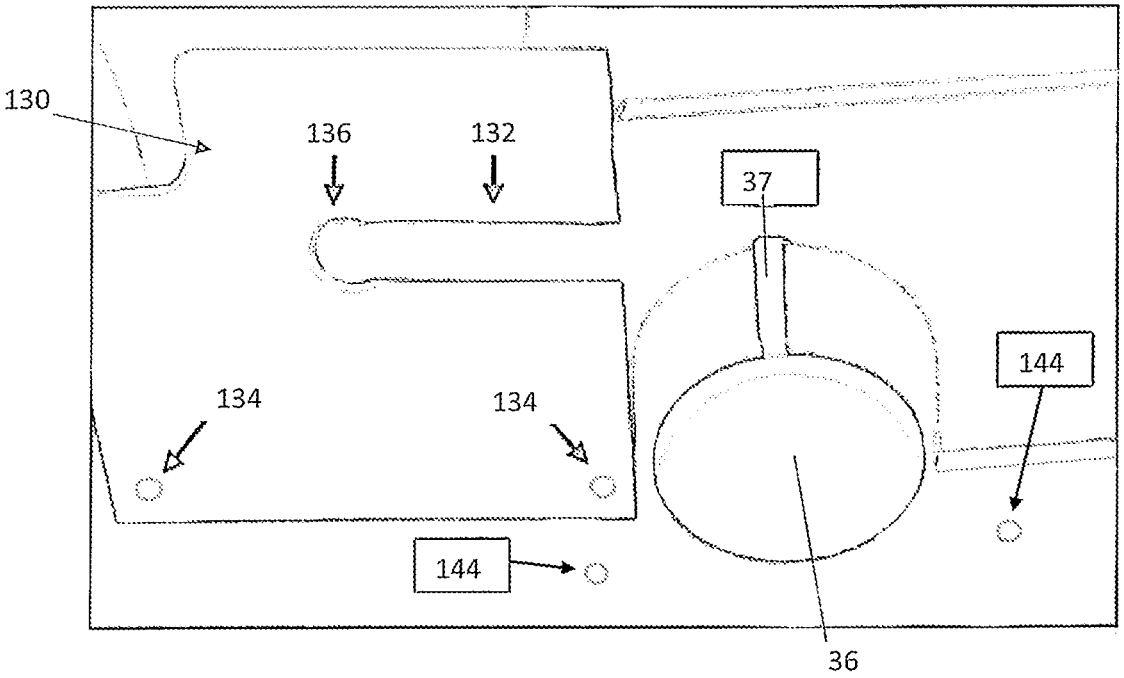
FIG. 5A shows a perspective view of a knob template for use with the support mechanism of FIG. 1.
Figure 5B:
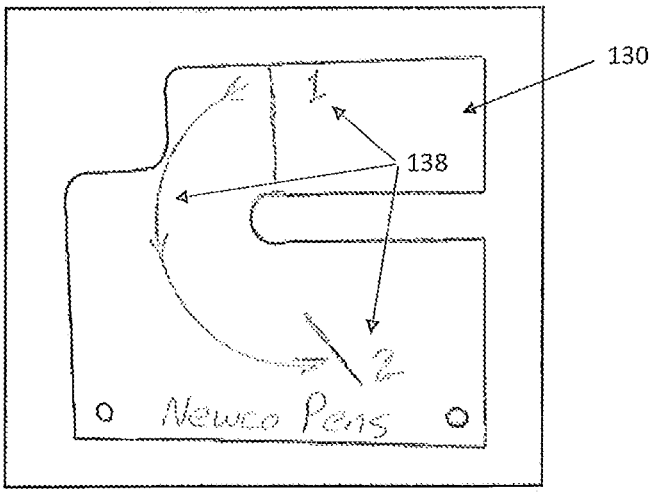
FIG. 5B shows the knob template of FIG. 5A including added markings unique to an exemplary processing job.

With reference now to FIGS. 5A and 5B, in at least one embodiment, a removable knob template 130 may be used in association with the rotisserie 10. The knob template 130 is a plate-like structure that includes a slot 132 and registration holes 134. Pegs 144 are provided on the rotisserie 10 to ensure the template 130 is retained in the same position during use. As shown in FIG. 5A, the slot 132 of the knob template 130 allows the knob template 130 to slide behind the knob 36 of the rotisserie, to a position where the knob template is positioned behind the knob 36 and provides a surrounding background for the knob. A widened area 136 of the slot 132 fits the knob template 130 to the shaft of the knob 36 without pinching the knob. The registration holes 134 are spaced apart and dimensioned to receive the pegs 144 extending from the rotisserie base. This engagement between the pegs 144 and the registration holes 134 maintains a constant position for the knob template 130 when in use. After the knob template 130 is used, it may be conveniently released from the rotisserie 10 by moving the registration holes 134 away from the pegs 144 and sliding the template 130 away from the knob 36 as guided by the slot 132.

As shown in FIG. 5B, the knob template 130 may include a number of markings 138 to assist the user in quickly and easily making the appropriate turn of the knob 36 to make multiple prints on objects during subsequent processing runs. The markings may include text, numerals, symbols, or other indicia to assist the user in knowing how to rotate the knob 36 in association with specific jobs. In the example of FIG. 5B, the knob template 130 includes (1) the "1" marking to indicate the first position for the knob reference 37 for printing on a first set of objects at a first orientation on the rotisserie 10, and (2) the "2" marking to indicate the second position for the knob reference 37 for printing on the first set of objects at a second orientation on the rotisserie 10. In other words, in order to print on multiple locations on the first set of objects, the knob 36 is first rotated to position "1" (i.e., reference 37 is aligned with the "1" marking), the first print is then made on the objects, the knob 36 is subsequently rotated such that the knob reference 37 arrives at position "2" (i.e., the reference 37 is aligned with the "2" marking), and the second print is then made on the objects. It will be recognized that any number of Additional notes/markings may be written on the template to assist the user in properly processing a job. For example, in FIG. 5B, the markings 138 include the job name (i.e., "Newco Pens") as well as arrows indicating the direction of knob rotation (i.e., from position "1" to position "2"). Further examples of marking include special notes associated with proper processing of the job (e.g., for a set of pens, the knob template 130 may include notes like, "Start pens with all clips to the left").

In at least some embodiments, the objects, rollers, rotisserie gears and knob do not all have the same diameter, so the knob must be turned more than 180 degrees in order to turn the pens 180 degrees. Some items may have such a large diameter that the knob must be turned more than 360 degrees to produce the desired rotation in the object. Again, this can simply be noted on the knob template. For example, "Ronco black flashlights—turn knob one full rotation, then to radial mark #2."

In view of the foregoing, it will be recognized that the knob template 130 shown in FIGS. 5A and 5B provides for a method of using a rotisserie 10 to make a knob template 130, and then using the knob template for subsequent processing runs. The method comprises the following actions.

1. Insert a knob template behind the knob, by sliding the slot along the knob shaft, and snap the knob template onto the registration pegs (e.g., see FIG. 5A).
2. Turn knob reference point/line straight up, and mark that position on the template (e.g., see FIG. 5A).
3. Place the objects onto the rotisserie at the first desired print position.
4. Turn the objects, using the knob, to the 2nd print position, and mark that position on the knob template.
5. If more print positions are desired, repeat step 4 for each position.
6. Number each position, mark the direction to turn the knob, the job name and any notes on the template.
7. Use the knob template for subsequent processing runs of the identified job with the same objects.
8. Remove the knob template and replace with different knob templates for processing different objects on different jobs (and/or replace the same knob template for processing the same objects on future jobs).

In various embodiments, it will be noted that, if an indicator position falls directly on the slot, all position marks can be moved the same distance around, such that the slot is skipped over. In this case, a fresh template may be used and started with the knob turned enough to avoid the slot.

Fixture with Custom Rail Members

Figure 6A:
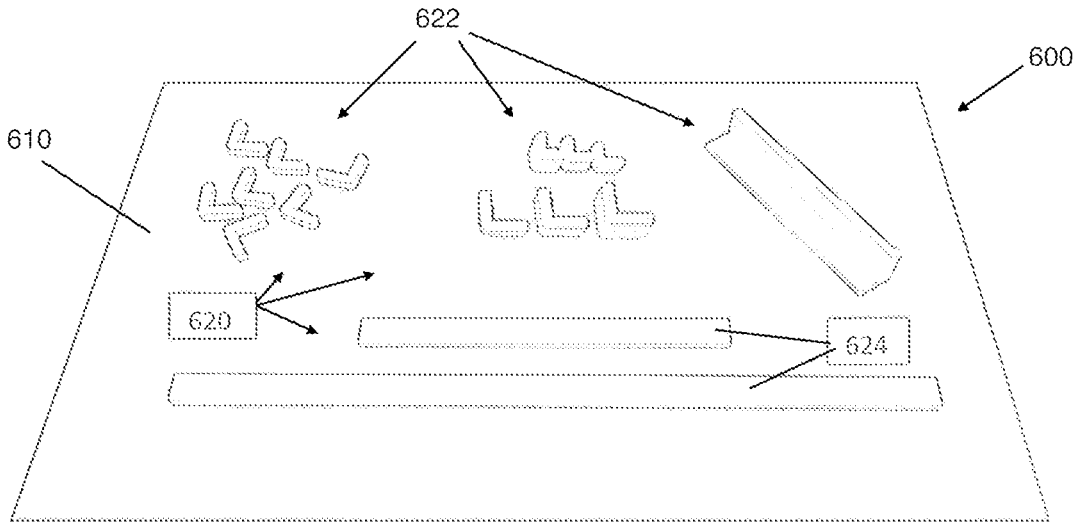
FIG. 6A shows a perspective view of one embodiment of a positioning system including a processing board and a plurality of rail members configured for arrangement thereon.
Figure 14:
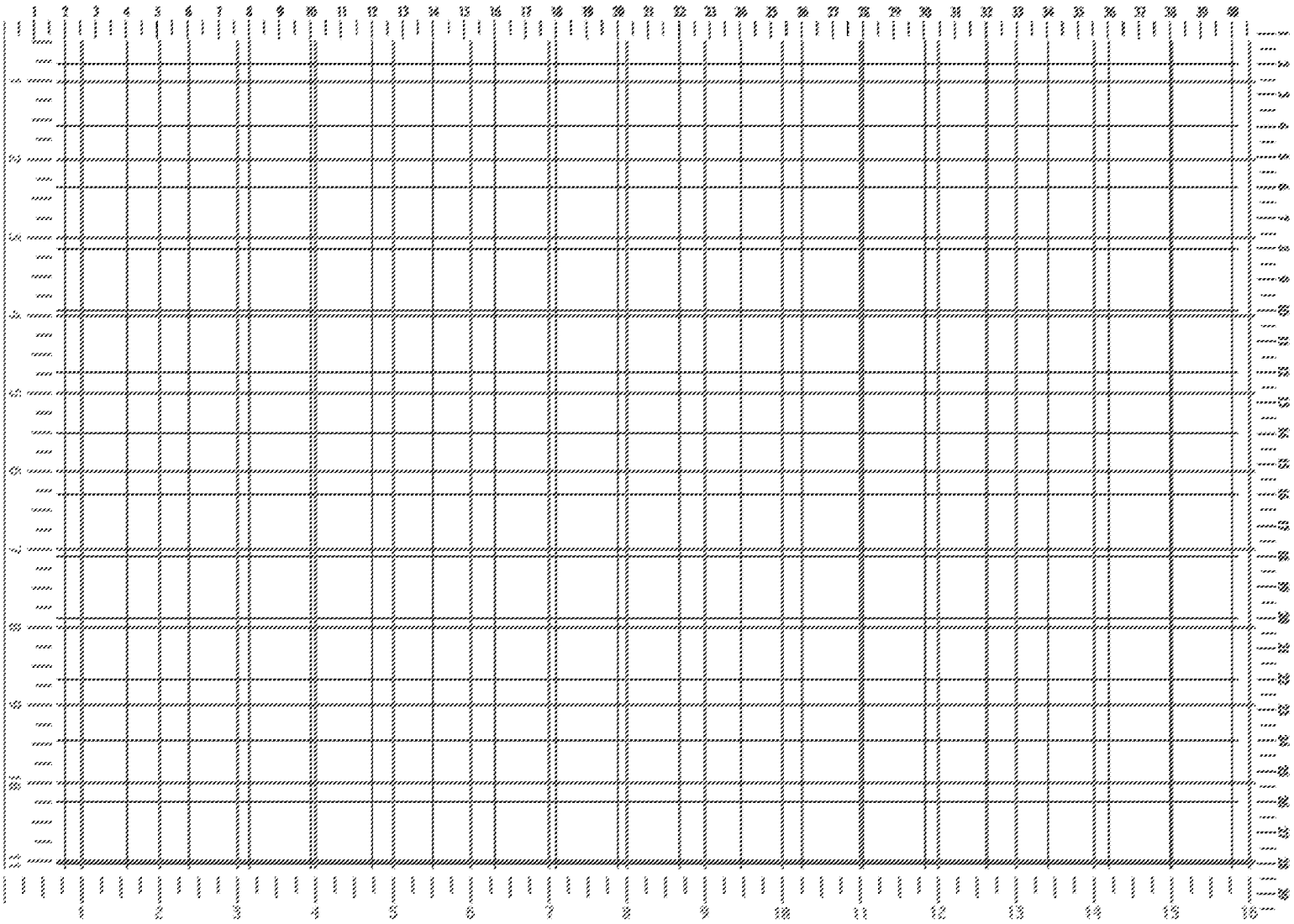
FIG. 14 shows a top view of a ruler grid screen for the processing board of FIG. 6A.
Figure 15:
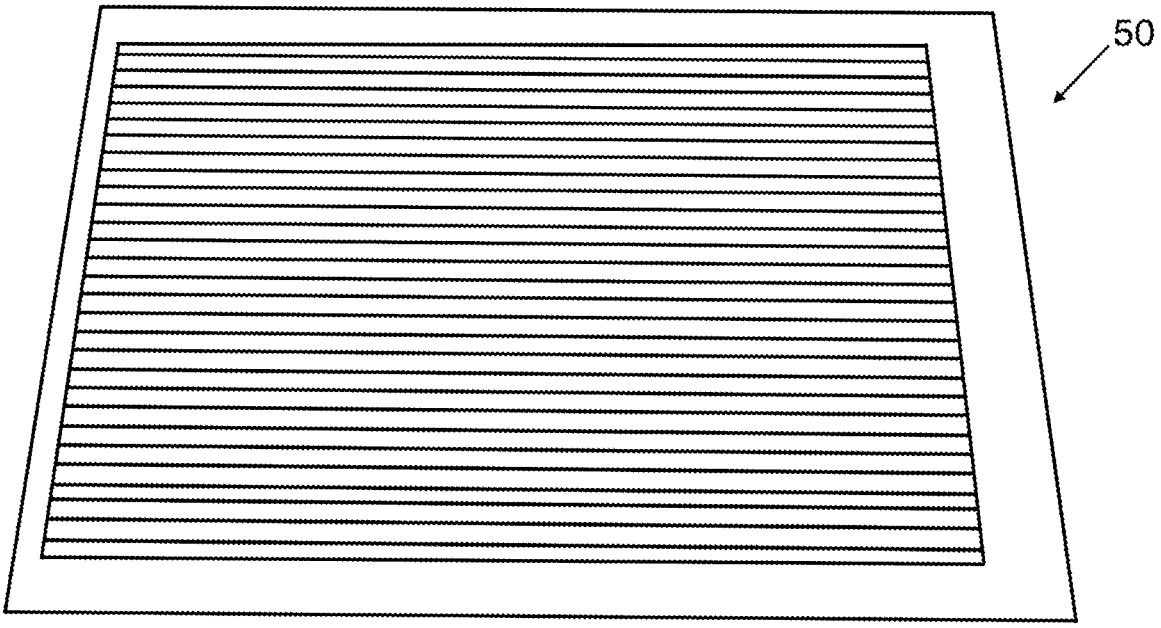
FIG. 15 shows a perspective view of the pre-loader of FIG. 2A with a corral frame positioned thereon.
Figure 16:
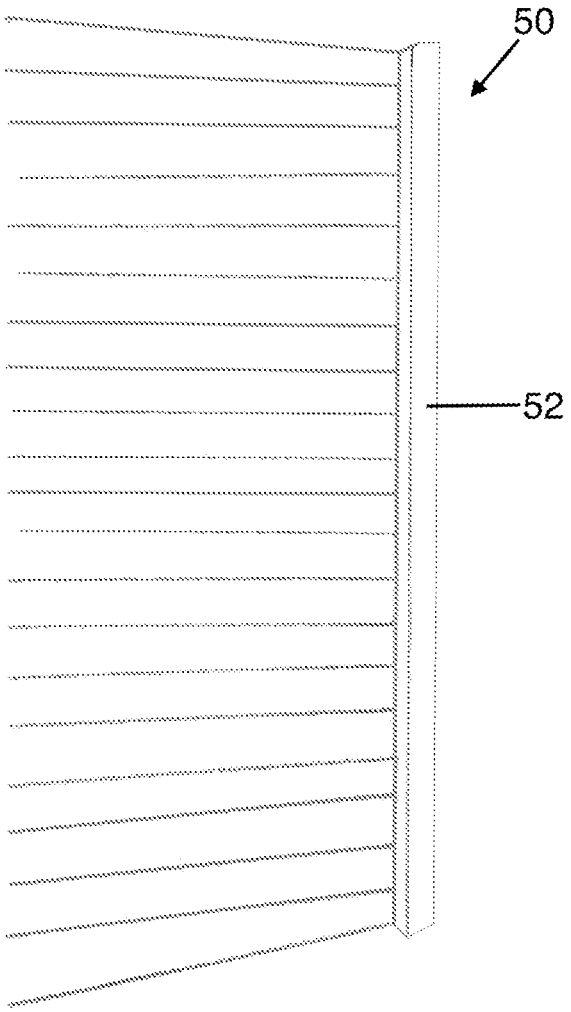
FIG. 16 shows a perspective view of an end of the pre-loader of FIG. 15 with the corral frame removed to expose a bumper on the end of the pre-loader.

With reference now to FIG. 6A, in at least one embodiment of the positioning system, a kit 600 is provided including a processing board 610 with a plurality of rail members 620 configured for arrangement thereon. The processing board 610 may be any processing board as is customary for printing or any other applicable processing. In at least one embodiment, the processing board includes only a relatively rigid board configured to support various processing objects. The processing board 610 is advantageously dimensioned to be arranged within by the processing station, such as arranged on a support plate of the processing station. For example, the processing board 610 may include registration members such as pins or other projecting members (not shown) or holes, recesses or other cavities. These registration members may be positioned in locations that are complementary to the registration members of the processing station. For example, the four corners of the board 610 may be configured to receive pins, telescoping legs, or other projecting members that extend from the support plate of the processing station (or vice-versa, wherein pins or projecting members on the board extend into cavities of the processing station). When the registration members are engaged with the complementary registration members on the processing station, the processing board 610 is properly positioned upon the processing station. In at least some embodiments, the processing board 610 further includes grid lines (such as those shown in FIG. 14). These grid lines are used to assist the user in accurately and precisely placing the rail members 620 on the board 610 in a certain configuration.

With continued reference to FIG. 6A, the rail members 620 of the kit 600 include any of a number of differently sized and shaped rail members configured to be quickly and easily secured to the board 610. The term "rail member" as used herein refers to any structure that is secured to the processing board 610 and used to form a boundary that defines proper placement of objects upon the board 610 for processing. In the embodiment of FIG. 6A, the rail members include brackets 622, and bars 624. The brackets 622 and bars 624 may be provided in any number of different sizes and shapes, including different heights, widths, and lengths, etc. The brackets 622 generally have a cross section that defines a concave polygon, such as an "L" shaped cross section. The bars 624 generally have a cross section that define a convex polygon, such as a rectangular cross section. Alternatively, the bars 624 may have a rounded (e.g., circular or elliptical) cross section. In any event, it will be recognized that the rail members 620 may take on any number of different forms, sizes and shapes, including shapes that do not have uniform cross-sections.

In at least one embodiment, the rail members 620 each include an adhesive material on a flat bottom surface of the rail member. In at least one embodiment, the adhesive material is provided as a peel-and-stick adhesive arrangement wherein the adhesive is covered with a releasable backing layer such as paper or plastic film. One example of such a peel-and-stick adhesive arrangement is that offered in association with the Command™ brand picture hanging strips, offered by the 3M Company of Maplewood, Minn. In such arrangements, when the backer layer is peeled away, the adhesive is exposed. Engagement of the exposed adhesive with another surface results in a coupling between the bottom surface of the rail member and the engaged surface. In other embodiments, glue or other adhesives may be added to the rail members 620 at the time the rail members are secured to the board 610.

Figure 6B:
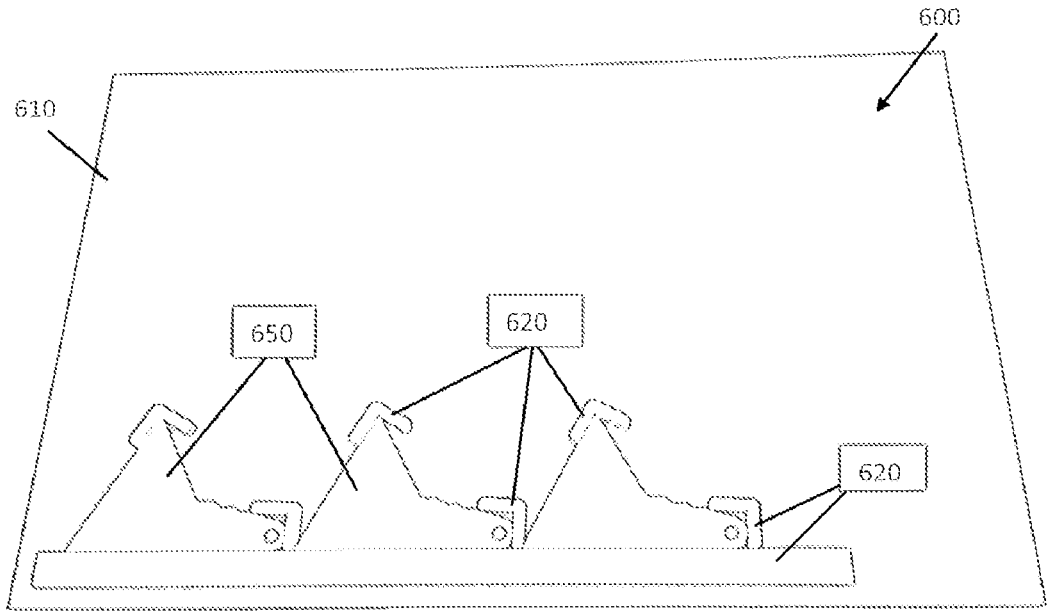
FIG. 6B shows the positioning system of FIG. 6A with the rail members arranged on the processing board in order to retain processing objects in a predetermined orientation upon the board.

In various embodiments, the above-described kit 600 may be packaged and sold in a single box. Also, the kit may or may not include a processing station such as a printer. In any event, the kit 600 may be advantageously used to form a custom processing fixture that may be used repeatedly in order to assist with additional runs of a previously completed printing or other processing job. FIG. 6B shows the fixture system of FIG. 6A with the rail members arranged on the processing board in an exemplary configuration for printing on a number of scraper objects 650. As shown in FIG. 6B, a user has arranged a number of rail members 620 in a custom configuration upon the processing board 610. The rail members 620 are all secured in place by the adhesive material on the bottom of each rail member. The rail members 620 are arranged on the board 610 to define borders for the scraper objects 650. This allow the user to quickly and easily position the scraper objects 650 upon the board, knowing that the scraper objects are in proper position for printing or other processing. As noted previously, grid lines on the board 610 may be of assistance in accurately positioning the rail members 620 on the board 610. The rail members 620 not only define the proper placement of the processing objects 650 on the board 610, but also help retain the objects in their proper position prior to and during processing. Because the board 610 includes registration cavities in the corners, it may be repeatedly positioned on the printer or other processing apparatus in the same position. Registration of the board 610 with the printer along with the pre-configured rail members 620 ensure that the processing objects 650 positioned on the board 610 are in a proper position for printing. The board 610 may be saved and used repeatedly to run future jobs of the same type (e.g., additional jobs for the scraper objects 650 of FIG. 6B).

Figure 7:
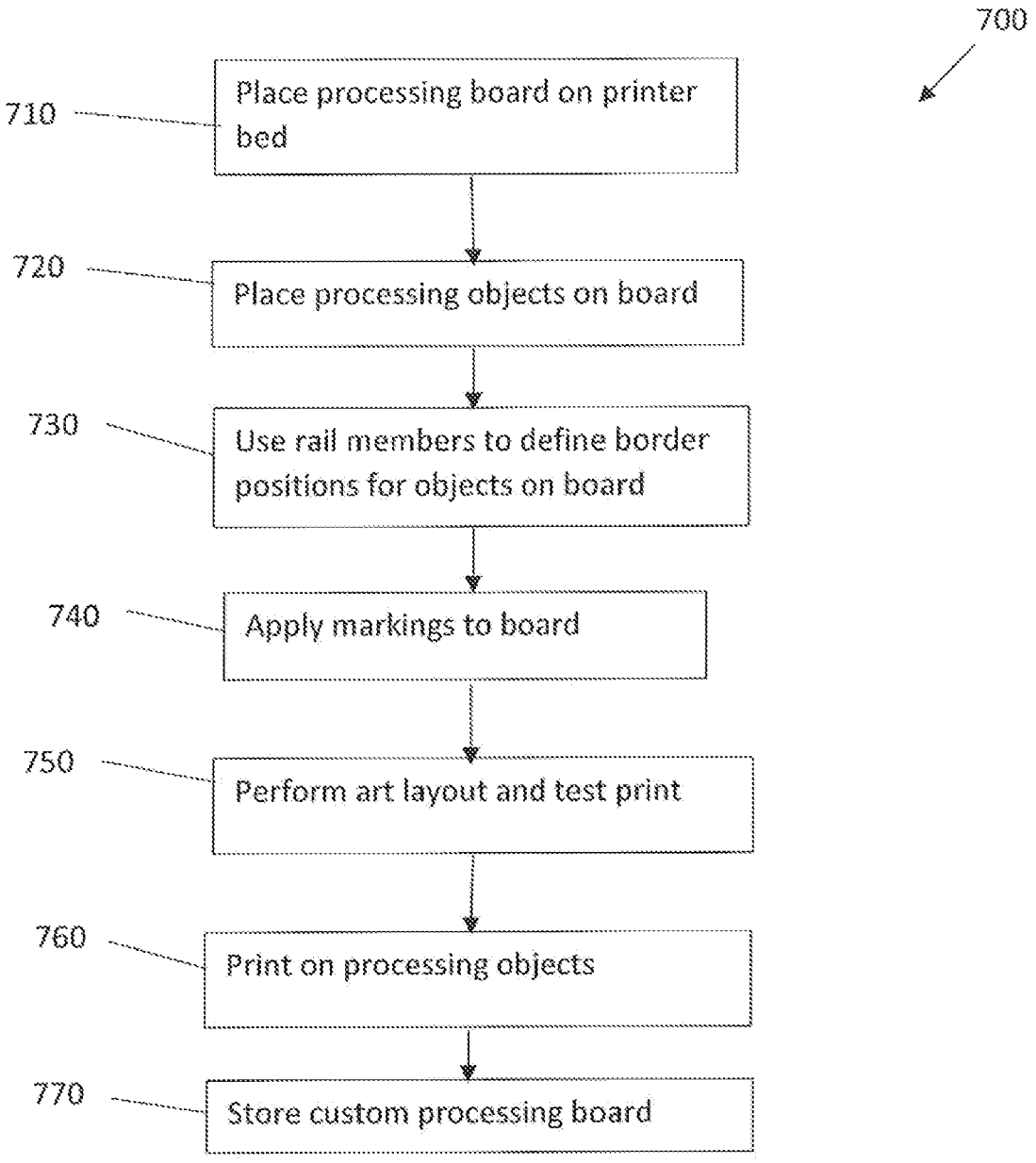
FIG. 7 is a flowchart of a method of making the processing board of FIG. 6B and processing objects thereon.

With reference now to FIG. 7 a flowchart is provided for a method 700 of making a custom processing board and processing objects thereon. The method begins at block 710 where a blank processing board 610 is obtained and placed on the printer bed (or other processing station). The processing board 610 includes a flat upper surface. The board 610 is registered into the correct position with the alignment pins of the printer's support plate. Thereafter, at block 720, the objects to be printed are placed on the processing board in a first configuration. The grid lines on the base plate may be used to square each of the objects. Double-sided tape tabs may be used to hold the processing objects in place.

After the processing objects are placed on the board, the method continues to block 730 where the rail members are used to define boarder positions for each of the processing objects. In other words, the rail members are arranged in positions around a perimeter of each of the processing objects. These perimeter positions are in sufficient proximity to the processing objects to either contact the perimeter of the object or prevent the object from moving outside of a tolerance movement distance (e.g., 1 mm, 2 mm, etc.). Because the rail members include a peel-and-stick adhesive on their bottom surfaces, this is easily accomplished by the user simply removing the backer layer from the bottom of the rail objects in order to expose the adhesive, and then simply placing the rail members on the processing board to frame border positions for the processing objects. Depending on the size and type of object, it may be easier for the user to frame the objects one at a time, prior to placing all of the objects on the board. The adhesive on the bottom of the rail members is pressure sensitive. Accordingly, the user may lightly place a rail member on the board and then aggressively press down on the rail member once it is in a desired position. Once force has been used upon the rail member, the adhesion between the rail member and the board is meant to be permanent.

After the rail members are placed on the board, the method continues to block 740 where markings are applied to the board. In at least one embodiment, the markings are used to provide a label indicative of a particular job the board is used for. In another embodiment, a pen or other writing utensil is used to trace the outline of some or all of the objects on the board in order to further illustrate proper placement of objects upon the board. This tracing step can be very useful in helping future users see where the objects are to be positioned on the board between the various rail members.

With all of the objects and rail members placed on the board, the method continues to block 750 where the printer is used to perform an art layout and test print. The test print may utilize the alignment apparatus of U.S. Pat. No. 10,654,261. Once the test print shows that the desired artwork is deposited into the desired locations, the user may proceed to block 760 with printing the actual objects.

After completing a job with all objects printed, the custom processing board is stored at block 770. The storage should be in a location that protects the board and shields it from damage. Thereafter, when a new job is received for the same objects, the board may be retrieved and used again for printing on the new objects. This saves valuable time for the user. In particular, the method 700 described herein allows the user to create an inexpensive but effective permanent fixture. The permanent fixture is quickly created on-site, so there is no need for the user to wait for many days or weeks while the permanent fixture is created. Additionally, because of the inexpensive cost, the user may decide to move forward with a custom permanent fixture even when it is not clear that a permanent fixture will be helpful (e.g., when it is not clear how many additional jobs/orders will be received). If no additional jobs/orders are received, the user has not invested significant expense in the fixture. However, if additional jobs/orders are received, the custom permanent fixture will assist the user in quickly and efficiently completing the future jobs.

Spacing Bridge

Figure 8:
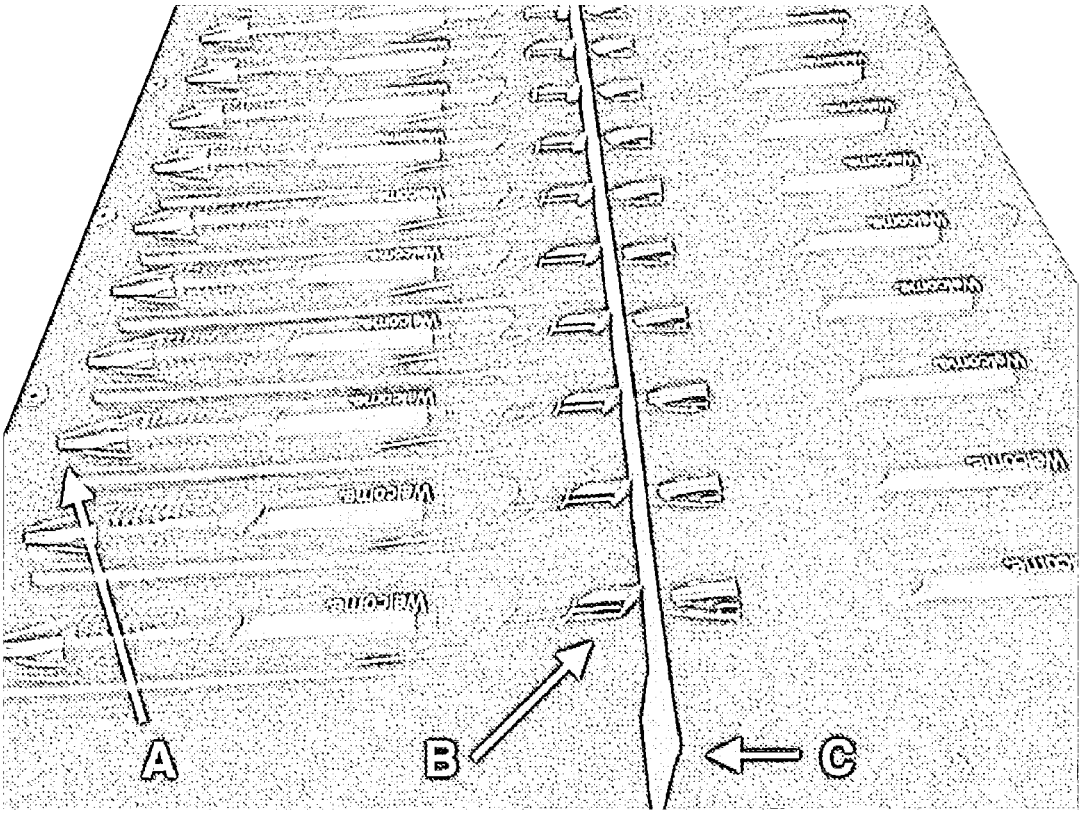
FIG. 8 shows the support mechanism of FIG. 1 with a spacing bridge used to separate objects supported by the rollers of the support mechanism.

In various embodiments of the positioning system, built-in spacing bridges are provided on the end blocks and the ball frame (described below), which can simply hinge down or slide down into place, and then hinge back or slide back out when needed. An example of a spacing bridge (C) arranged between rows of pens on the rotisserie is shown in FIG. 8. The spacing bridge is advantageously used to avoid unwanted engagement of surfaces and components (B) on adjacent objects that would interfere with proper rotation of adjacent objects when the rollers (A) of the rotisserie are rotated. As noted previously, the spacing bridges may also be advantageous when loading and unloading objects from the pre-loader in order to better control the objects during loading and unloading.

In view of the above, the positioning system disclosed herein provides a method of using the pre-loader, one row of items at a time. Using a spacing bridge, ruler or stiff straight edge, the items that are preloaded on the pre-loader are swept off the pre-loader onto the rotisserie one row at a time, to maintain better control of the process when the objects are odd-shaped or unwieldy in such a way as to be susceptible to dislodging from the correct positions.

Ball Frame

Figure 9:
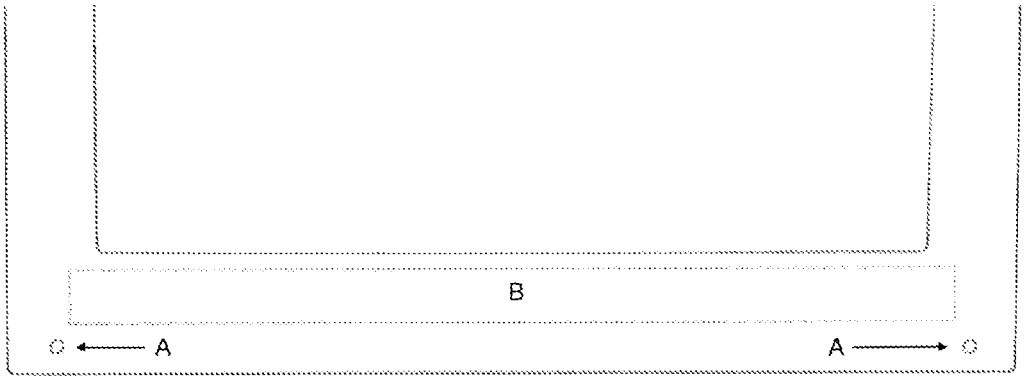
FIG. 9 shows a top view of one end of a ball frame for use with the support mechanism of FIG. 1.
Figure 10:
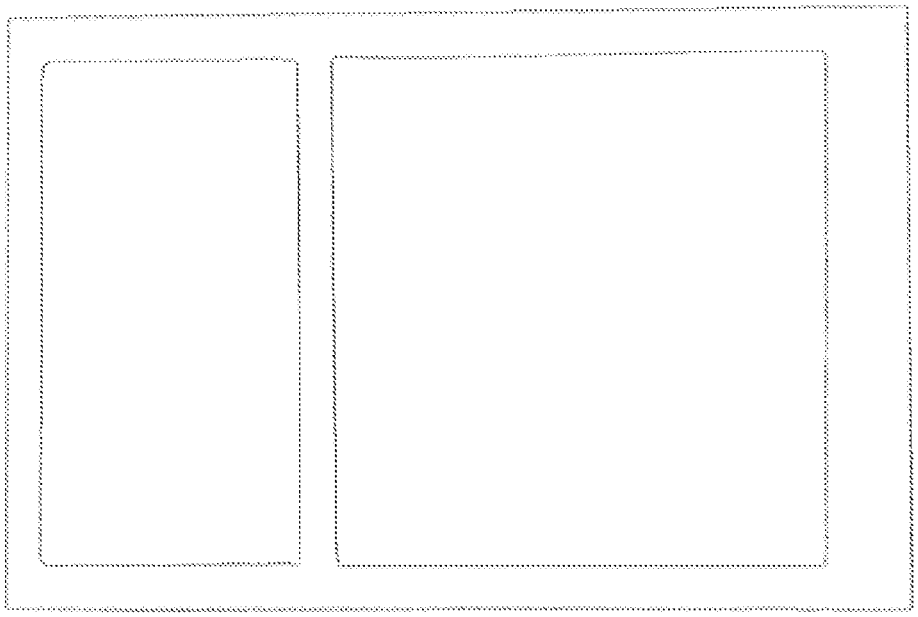
FIG. 10 shows a top view of the ball frame of FIG. 9 with a crossmember positioned across the ball frame.
Figure 11:
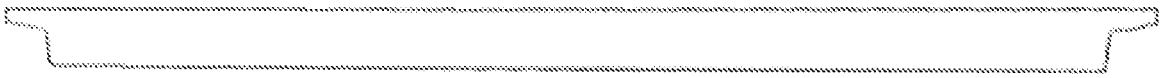
FIG. 11 shows a side view of the crossmember of FIG. 10.

With reference now to FIGS. 9-11, in at least one embodiment, the positioning system includes a ball frame with a trough (B) (which may also be referred to herein as a "slot") cut on the underside of the ball frame. The ball frame is configured to sit on the rotisserie. The trough (B) allows the ball frame to be used as a corral frame, by fitting the trough (B) onto the preloader bumper 52 (as shown in FIGS. 2B, 3A, 15 and 16). The ball frame and trough (B) also provide for a method for using the ball frame for retaining balls placed on the rotisserie. The ball frame has mounting sockets (A) corresponding to the telescoping legs on the rotisserie base, which positions the ball frame to contain the balls at a height that is adjustable for balls of various radii. The ball frame is placed on the extended telescoping legs of the rotisserie. The ball frame is pushed down (causing the legs to retract) until the center of the frame is approximately at the height of the center of the balls. A separate crossmember spans the ball frame (see FIG. 10) perpendicular to the rotisserie rollers and can be positioned anywhere along the frame to contain various numbers of balls of various radii, and prevent them from rolling out of place. The crossmember can be secured in position on the ball frame by attachment via various means such as pegs, screws, bolts, notches, tabs, clamps or clips. The preferred embodiment provides a ball frame with slightly flexible rails, such that the crossmember, with slightly tapered ends (see FIG. 11) can easily be pushed in and snapped into place, as it flexes the frame outward. The frame's reflexive force holds the crossmember securely in place with no screws or other hardware needed.

Figure 12:
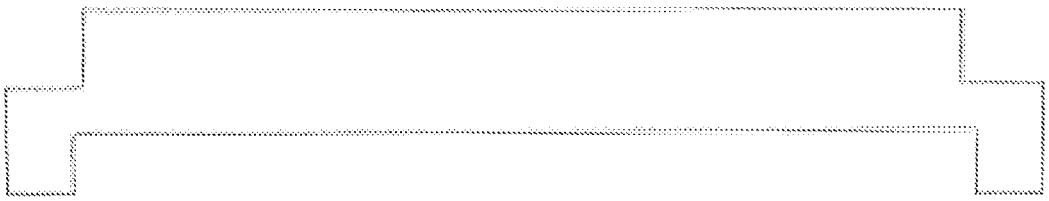
FIG. 12 shows a front view of an alternative embodiment of the spacing bridge of FIG. 8 that may be used in association with the crossmember and ball frame.
Figure 13:
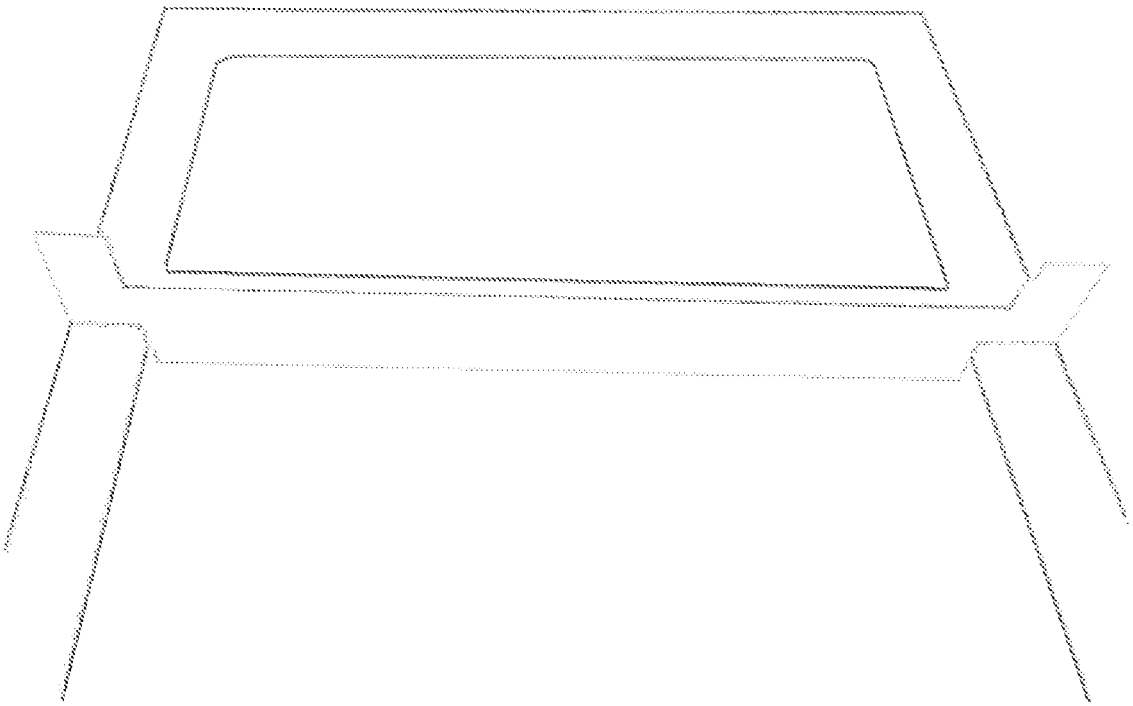
FIG. 13 is a perspective view of the spacing bridge of FIG. 12 positioned with the crossmember in a ball frame.

To ensure that balls within the ball frame can be rotated free of friction with the ball frame, the above described spacing bridge can be inserted alongside the crossmember as the crossmember is snapped into position. Then the spacing bridge is removed before printing, to prevent friction from hindering rotation of the balls. The design of the spacing bridge in the above described applications for the end block and object array would not work properly with the ball frame. One embodiment provides a separate spacing bridge designed to properly fit the ball frame. In such embodiment, the above described end block spacing bridge has an extended top section, such that it can be turned upside down for use in the ball frame (See FIGS. 12 and 13). FIG. 13 shows the multipurpose spacing bridge turned upside down for use in the ball frame adjacent to the crossmember. When the spacing bridge is in this upside position on the ball frame, it acts to space the balls from being pinched too tightly by the crossmember. When the balls and everything are in place, and ready to print, the user pulls out the spacing bridge to provide just enough slack so the balls will rotate freely. Accordingly, it will be appreciated that the spacing bridge of FIGS. 12 and 13 is thus configured to serve as a spacing bridge for the rotisserie, and when turned upside down, it may alternatively serve as a spacing bridge for the ball frame.

In another embodiment, the ball frame also has sockets or holes on top to retain additional telescoping legs to support the alignment frame to be used in locating art positions for the balls, then test printing and checking the art aesthetic, size, orientation, and position. In another embodiment, which may be used for balls of smaller diameters, the alignment frame may be placed directly on top of the ball frame, so long as the alignment frame glass clears the top of the balls. In this embodiment, the alignment frame may be clipped to the ball frame, or attached with other hardware such as pegs, screws, bolts, notches, or tabs.

The versatility of the UV inkjet printers and other machines mentioned above allows printing or processing of an endless variety of items. Many items are square or rectangular, such as books, cell phones, cell phone cases, picture frames, instrument panels, cards, coasters, tiles, boxes, ipads, external hard drives, labels, nameplates, signs, and more. The disclosure of U.S. patent application publication US 20170073163 provides a fixture pad, which adequately serves to aid the positioning for printing or processing of such square or rectangular items. However some of these items are relatively large, such as a book or sign, and it may be unnecessary or undesirable to place such a large item on a large tacky surface, especially if the item's surface has low structural integrity or a coating with weak adhesion to the item. The positioning system disclosed herein provides a ball frame method and a ball frame that further contains alignment holes to allow quick, easy placement of the ball frame directly on the bed of the printer or other machine, and then quick, easy placement of the square or rectangular item against an inside corner of the ball frame for the purpose of aligning it parallel with the bed of the printer or other machine, thus using the ball frame itself as the fixture for such objects. Some square or rectangular items are small enough to fit multiple objects at once in the ball frame, placed directly against each other in formation. If the operator perceives a risk of accidental dislodgment of the small items, it may be preferable to use the fixture pad of US 20170073163, possibly using the same method of direct contact formation.

As will be recognized the disclosed positioning system provides a ball frame that further contains sockets or holes for placement of telescoping legs to support the alignment frame above the ball frame, for use in locating the desired art coordinates, test printing and checking the art, when the ball frame is used as the fixture for square or rectangular objects.

Ruler Grid Screens

In order to further aid in positioning and checking the art, the positioning system disclosed herein also provides ruler grid screens (see FIG. 14) made of paper or transparent material (transparencies), and a rotisserie, fixture pad, alignment frame, and ball frame that each have rulers printed on all edges surrounding the printing or processing area, or rulers denoted in some other way, such as etched or molded. In addition, the present invention provides a rotisserie with integers printed on the two end blocks that support the rollers. The integers denote the numbered positions of each space between adjacent rollers, where columns of objects will be positioned. This aids in laying out art on the software and identifying positions of items for communication of instructions, tasks and issues that may arise during the job. For this same purpose, each part of the fixture system can be labeled with its name, such as "ball frame", "alignment frame", "spacing bridge", etc., which may also aid new users in learning the system.

The ruler grid screens show both inches and centimeters, and can be used in several different ways in conjunction with the alignment frame and fixture pad. It can be placed on the alignment frame above a set of objects on the rotisserie or fixture pad, such that a user can visually locate the coordinates of the target for printing or processing. The user may mark the position for each object using a marker such as a 3M® Post-it Arrow, then paste the art at those coordinates in the software. With many jobs, only one column and one row would need to be marked and noted, as those coordinates can then be used to locate art for all objects in the array.

In another embodiment, the ruler grid screen can be laid over a pattern sheet that was made for the fixture pad, again for the purpose of locating coordinates for the art, using the same method just described.

In at least one embodiment, a method with the following steps is used to make a pattern sheet, make the software art file, test print, adjust, and print the first batch of items:

1. Place a white background sheet on the alignment frame, with a ruler grid transparency screen on top, and a blank transparency on top of that.
2. Place the objects in a desired formation to be printed, using the ruler grid as a visual indicator of parallelness.
3. Trace around the objects onto the blank transparency to make the new pattern sheet.
4. Remove the objects, and mark each desired artwork position with a Post-it arrow.
5. Use the ruler grid to determine coordinates for positioning artwork in the software.
6. Replace the transparencies with a new blank paper for test printing.
7. Lay the newly created pattern sheet transparency over the test print to visually check art aesthetic, size, orientation, and position.
8. Make any necessary adjustments in the art or software, reprint and recheck if needed.
9. Replace the Alignment frame with the fixture pad, and insert the newly created pattern sheet in the slot underneath.
10. Put the objects in place using the pattern sheet as a guide.
11. Start printing.

Subsequent orders for this job will only require steps 9-11.

Note: At step 9 above, the user may have another option. Large flat objects may lay securely by virtue of their own weight, in which case, the user may choose to continue using the alignment frame as the fixture for printing, by simply placing the objects directly on the pattern sheet, or first placing a shielding transparency to protect the pattern sheet, before placing the objects.

Also note at step 6 above, the user has the option of test printing on a transparency, thereby allowing another option at step 10 of using the alignment frame to view the test print directly above the objects that are in position to be printed.

Because the alignment frame is used for printing the transparency in the steps above, and may even be used as the fixture for printing certain objects, the present invention also provides an alignment frame with holes positioned to enable direct placement onto the printer bed with correct positioning using registration hardware such as pins, pegs or screws.

The disclosed positioning system also provides ruler grid screens and pattern sheets of paper and transparency that have pinpoint registration dots near some or all corners, which can be aligned to corresponding registration points on the alignment frame and the fixture pad, to aid more precise placement of the sheets, screens, and the resulting prints.

Corral Frame

When placing many round or cylindrical items onto the pre-loader, there may be a tendency for some objects to roll before becoming nested in the grooves. This is especially true with small parts, where efficiency calls for dumping many of them onto the pre-loader and manually "smearing them around" to induce their nesting into the grooves. Thus the disclosed positioning system also provides a corral frame (see FIG. 15) designed and sized to fit completely or substantially around the pre-loader, and extending higher than the pre-loader, thereby effectively creating a surrounding retaining wall to prevent parts from rolling off before they are fixed in place in the grooves.

It will be recognized that, in at least one embodiment, the ball frame design may be adapted to serve as both the ball frame and the corral frame. In the preferred embodiment, the wide end of the ball frame has a slot (see the slot in FIG. 9 where (B) is identified between the two mounting sockets (A)) which fits the bumper (see FIG. 16) at the front end of the pre-loader. The ball frame is simply set down onto the pre-loader with the bumper in the slot, which fixes the ball frame in position.

The disclosed positioning system also provides at least one indicator point, arrow, stripe or other mark on the alignment frame corresponding to the leg positions to visually accentuate those positions for operators. Alternately, corresponding marks can be placed on both the alignment frame and the supporting base below it, again to visually accentuate those positions for operators.

Graphical User Interface

The positioning system also provides for a software system with a graphical user interface (GUI). The GUI includes a "Fill all columns" function in the software template that lays out the artwork for printing. In the case of the rotisserie, each column (shown by a dotted line) represents the center line between each roller of the rotisserie, which is where the art will be centered on the items. Thus, only the row positions need to be located by the operator using the ruler grid screen/3M Post-it Arrow method mentioned above, because the column coordinates are already in the software template. Thus, the operator can paste the art at each row point on the first column in the software, and simply click the "fill all columns" button to populate the art in all other columns. In addition, a "fill even columns" function works similarly, but skips every-other roller for situations where larger diameter items do not fit on every roller. In addition, a "fill every 3rd column" function works similarly, and 4th, 5th and so on, for ever increasing larger diameter items.

The GUI also provides a "Show art in printer" function, for the operator to see a rendering of the actual printer with the field of art superimposed into the correct position. This provides additional confirmation for the operator that the art has been set up correctly. The present invention also provides a "fit to item width" function, which allows the operator to enter the diameter of the item, and have the software resize the art accordingly, based on known limits of the printing machine to print on curved objects. For example, simply printing a 1"×1" image onto a 1" diameter object will result in poor resolution near the horizontal edges of the image, as it is being printed on a sever slope nearly ½" away from the print heads. For a round object with a given diameter, an art size can be calculated by the software such that good resolution will result across the entire art.

The GUI also provides a "Show Fixture" feature whereby the software being used to prepare the field of art for printing shows a rendering of the fixture in the software, as the operator uses the software to position the art. The rendering of the fixture may be partially translucent, or "grayed-out" or visually recessed in some other way, to help highlight the actual printable area the operator is working in. The "Show Fixture" feature provides additional confirmation for the operator that the art is being set up correctly.

The GUI also provides a method of scanning a tracing to multiply in the art layout software. In making a pattern sheet for items to print on the tack plate or the alignment frame, one method is to trace around each item onto the pattern sheet. The present invention provides a method to trace only one of the items, scan the tracing into the software and use the software to reproduce the tracing. Then the operator uses the software to place the tracing copies in the pattern desired, and print out the pattern to make the pattern sheet. If desired, the art test print can be made simultaneously.

The GUI also provides a video instruction with subject index. Video demonstration can be a more efficient and effective way of conveying concepts than text. So the present invention provides a video user manual to help operators learn how to use the Universal Fixture. To further simplify the process, an index of subjects and times (points in the video timeline) is shown below the video screen, so the operator can return to the video for a refresher demonstration of any particular concept he/she wants.

Leveling Bands

In at least one embodiment, the positioning system disclosed herein further provides a series of different sized thick elastic leveling bands which can be placed on a conical object to level it for printing and for turning correctly on the rotisserie. For a conical object of a given size, the operator chooses the appropriate sized elastic leveling band to place around the narrow end of the conical object, and slide it up to a position that results in leveling the object when placed horizontally on the rotisserie.

Adjustable Rollers in Rotisserie

The positioning system disclosed herein also provides adjustable spacing of the rollers in the rotisserie. There are round printable objects with many different diameters, which would nest with better fit if the spacing between rollers were customizable, based on the diameter. This is accomplished in any of several ways, including one or both end blocks having a top half and a bottom half, with the top half being easily removable to allow for easy removal of certain interior rollers. The end block top half is held in place by any of various means such as pegs, screws, bolts, notches, tabs, clamps or clips. This can also be accomplished using a mechanism such as a lever to mechanically raise certain rollers above the others, thereby removing the remaining rollers from contact with larger diameter items placed on the rotisserie. The most likely used alternate formation is to use alternate rollers (roller numbers 1, 3, 5, 7, 9, etc.). Therefore, the odd numbered rollers have a different color than the even numbered rollers, for visual distinction to aid in this adjustment and in other aspects of using the rotisserie.

Geared Control Knob

In at least one embodiment, the positioning system disclosed herein also provides a rotisserie control knob fitted with multiple gears to allow adjustable, more efficient turning of larger diameter items, using relatively small diameter rollers.

Incorporation Into Printer

Various embodiments of the positioning system for object processing are disclosed herein. In the disclosed embodiments, the positioning system is not directly incorporated into the printer or other processing station. Nevertheless, in other embodiments, the positioning systems may be directly incorporated into the processing station. For example, in at least one embodiment, an alignment frame is provided inside the printer. The alignment frame slides over into an inner storage socket and may be selectively moved into an out of the processing area. In other embodiments, a printer bed could be completely replaced by the rotisserie, tack plate, or other positioning system.

Although the various embodiments have been disclosed herein, it will be appreciated by those of skill in the art that other implementations and adaptations are possible. Furthermore, aspects of the various embodiments described herein may be combined or substituted with aspects from other features to arrive at different embodiments from those described herein. Thus, it will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of printing on a plurality objects comprising:

arranging a first plurality of objects on a board having a flat upper surface, the first plurality of objects arranged on the board in a first configuration;

adhering a plurality of rail members to the flat upper surface of the board, the plurality of rail members arranged around a perimeter of each of the first plurality of objects to define borders for each of the first plurality of objects in the first configuration;

positioning the board on a printer;

printing on the first plurality of objects with the printer;

removing each of the first plurality of objects from the board;

arranging a second plurality of objects on the board, each of the second plurality of objects arranged within the borders defined by the rail members such that the second plurality of objects are also arranged on the board in the first configuration;

repositioning the board on the printer; and printing on the second plurality of objects with the printer.

2. The method of claim 1 wherein the board is positioned on the printer either before the first plurality of objects are arranged on the board or before the plurality of rail members are arranged around a perimeter of each of the first plurality of objects.

3. The method of claim 1 wherein each of the rail members includes a peel-and-stick adhesive arrangement on a lower surface of the rail member, and wherein adhering the plurality of rail members to the flat upper surface of the board comprises peeling a backing layer from each rail member and pressing said rail member against the board.

4. The method of claim 1 wherein the board includes grid lines and wherein adhering the plurality of rail members to the flat upper surface of the board includes aligning at least one of the rail members with at least one of the grid lines.

5. The method of claim 1 wherein the rail members include a plurality of brackets and a plurality of bars.

6. The method of claim 1 further comprising tracing an outline of at least one of the first plurality of objects on the board.

7. A method for processing a plurality objects at a processing station, the method comprising:

arranging a first plurality of objects on a board, the first plurality of objects arranged on the board in a first configuration;

marking border positions on the board for each of the first plurality of objects;

positioning the board on the processing station;

processing the first plurality of objects at the processing station;

removing each of the first plurality of objects from the board;

arranging a second plurality of objects on the board, each of the second plurality of objects arranged within the border positions marked on the board such that the second plurality of objects are also arranged on the board in the first configuration; and processing the second plurality of objects at the processing station.

8. The method of claim 7 wherein marking the border positions comprises adhering a plurality of rail members to a flat upper surface of the board, the plurality of rail members arranged around a perimeter of each of the first plurality of objects to define the border positions for each of the first plurality of objects in the first configuration.

9. The method of claim 8 further comprising selecting the plurality of rail members from a kit comprising a plurality of differently sized or shaped brackets and a plurality of differently sized or shaped bars.

10. The method of claim 7 wherein marking the border positions comprises tracing an outline of each of the first plurality of objects on the board.

11. The method of claim 7 wherein the processing station is a printer, and wherein processing the first plurality of objects at the processing station comprises printing on each of the first plurality of objects.

12. The method of claim 7 further comprising repositioning the board on the second processing station before the second plurality of objects are arranged on the board.

13. The method of claim 7 wherein positioning the board on the processing station comprises registering the board on the processing station by joining registration members on the board with complementary registration members on the processing station.

14. An object processing kit comprising:

a printer;

a board comprising a flat upper surface and at least one registration member, the at least one registration member configured to engage at least one complementary registration member on the printer; and a plurality of rail members, each of said plurality of rail members comprising a peel-and-stick flat bottom surface configured for engagement with the flat upper surface of said board.

15. The object processing kit of claim 14 further comprising a plurality of markings on the board.

16. The object processing kit of claim 15 wherein the plurality of markings include a plurality of grid lines.

17. The object processing kit of claim 15 wherein the plurality of markings include outlines of a plurality of processing objects.

18. The object processing kit of claim 14 wherein the plurality of rail members include a plurality of brackets and a plurality of bars.

19. The object processing kit of claim 18 wherein the plurality of brackets include a plurality of differently sized and shaped brackets, and wherein the plurality of bars include a plurality of differently sized and shaped bars.

20. The object processing kit of claim 14 wherein the board is configured to be releasably secured to the printer via said at least one registration member.

* * * * *